US005810447A

United States Patent [19]

Christopher et al.

[11] Patent Number: 5,810,447

[45] Date of Patent: Sep. 22, 1998

[54] APPARATUS AND METHOD FOR CONTINUOUS MINING

[75] Inventors: David A. Christopher, Idamay; Larry G. Offutt, Morgantown, both of W. Va.

[73] Assignee: Arch Mineral Corporation, St. Louis, Mo.

[21] Appl. No.: 530,748

[22] Filed: Sep. 19, 1995

Related U.S. Application Data

[63] Continuation of Ser. No. 428,952, Apr. 26, 1995, abandoned.

[51] Int. Cl.[6] ..... E21C 35/24

[52] U.S. Cl. ..... 299/30; 299/64; 299/67

[58] Field of Search ..... 299/30, 37, 43, 299/44, 18, 63, 64, 67

[56] References Cited

U.S. PATENT DOCUMENTS

| | | | |
|---|---|---|---|
| 2,826,402 | 3/1958 | Alspaugh et al. . | |
| 3,225,678 | 12/1965 | Densmore . | |
| 3,858,940 | 1/1975 | Lagowski | 299/18 |
| 4,312,540 | 1/1982 | Thompson | 299/11 |
| 4,418,872 | 12/1983 | Nelson | 241/187 |
| 4,474,287 | 10/1984 | Thompson | 198/812 |
| 4,773,520 | 9/1988 | Doerr et al. | 198/301 |
| 4,784,257 | 11/1988 | Doerr | 198/594 |
| 4,852,724 | 8/1989 | Bodimer | 198/861.2 |
| 4,865,185 | 9/1989 | Bodimer | 198/861.2 |
| 4,869,358 | 9/1989 | Chandler | 299/11 X |
| 4,884,847 | 12/1989 | Bessinger et al. | 299/1 |
| 4,957,405 | 9/1990 | Roberts et al. | 414/339 |
| 4,969,691 | 11/1990 | Moore et al. | 299/18 |
| 4,981,327 | 1/1991 | Bessinger et al. | 299/1 |
| 5,112,111 | 5/1992 | Addington et al. | 299/18 |
| 5,161,857 | 11/1992 | Mayercheck et al. . | |
| 5,185,935 | 2/1993 | McMillion et al. | 33/1 |
| 5,232,269 | 8/1993 | Addington et al. | 299/67 |
| 5,261,729 | 11/1993 | Addington et al. | 229/64 |
| 5,348,130 | 9/1994 | Thomas | 198/312 |
| 5,364,171 | 11/1994 | Addington et al. | 299/18 |

FOREIGN PATENT DOCUMENTS

| | | | |
|---|---|---|---|
| 1373170 | 11/1974 | United Kingdom | B65G 23/16 |
| 9502746 | 1/1995 | WIPO | E21C 41/28 |
| 9502747 | 1/1995 | WIPO | E21C 41/28 |

*Primary Examiner*—Frank Tsay
*Attorney, Agent, or Firm*—Webb Ziesenheim Bruening Logsdon Orkin & Hanson, P.C.

[57] ABSTRACT

Apparatus for controlling the operation of a mining system including a continuous miner, a tramming conveyor and a load-out vehicle operatively connected to the tramming conveyor. The apparatus includes a master computer processor on the continuous miner and at least one slave computer processor under the direction of the master computer processor for controlling elements of the mining system other than the continuous miner. A pair of parallel data communication highways connect the master computer processor and the slave computer processor and the functional status of the data communication highways is monitored. A radio communication path is provided between the master computer processor and the mining system. The master computer processor operates the mining system in an automatic mining mode of operation when both data communication highways are functional and operates the mining system in a reverse mode of operation if either data communication highway fails to function. In the reverse mode, all mining operations stop and the mining system can be reversed out of a mine hole. The master computer processor operates the mining system in a manual, radio controlled mode of operation if both data communication highways cease to function.

14 Claims, 11 Drawing Sheets

APPARATUS AND METHOD FOR CONTINUOUS MINING

This application is a continuation of application Ser. No. 08/428,952, filed Apr. 26, 1995, now abandoned.

BACKGROUND OF THE INVENTION

1. Field of the Invention

The invention relates generally to a system for continuously mining coal in a highwall and more particularly to such a system having a substantially automatic sequential control for a continuous miner and a combination articulated haulage/tramming conveyor and a load-out and control vehicle for use with the miner and the conveyor.

2. Description of the Prior Art

Coal is typically found in substantially horizontal seams extending through rock strata such as limestone, sandstone or shale. Surface mining and underground mining are the primary methods used to mine coal. Surface mining may be strip mining which involves the removal of the overburden by means of a drag line or other earth moving equipment to fully expose the coal seam for recovery. However, strip mining is limited by the depth of the overburden, which eventually makes strip mining impractical. When the depth of the overburden makes strip mining impractical, a large quantity of coal may remain in a seam. Recovery of this coal is accomplished by highwall mining wherein an entry or a hole is initiated at the exposed face of the seam at the highwall, and mining follows the seam inwardly from the highwall. A method and apparatus of mining a highwall are disclosed in U.S. Pat. Nos. 5,364,171; 5,232,269; 5,261,729 and 5,112,111, respectively entitled "Apparatus and Method for Continuous Mining"; "Launch Vehicle for Continuous Mining Apparatus"; "Apparatus for Continuous Mining"; and "Apparatus and Method for Continuous Mining", which are owned by Mining Technologies, Inc. Early highwall mining technology included mobile conveyors such as disclosed in U.S. Pat. No. 4,957,405, entitled "Apparatus for Mining". A control for a continuous miner and a trailing conveyor which may be used in highwall mining is disclosed in U.S. Pat. No. 5,185,935, entitled "Method and Apparatus for Separation Measurement and Alignment System". A combination haulage and tramming conveyor is disclosed in United Kingdom Patent No. 1,373,170, entitled "Plate Conveyor".

SUMMARY OF THE INVENTION

The present invention provides a substantially fully automated system for highwall mining. The operation of the equipment in the system is computer controlled and the system is capable of automatically mining in excess of 1,000 feet into a highwall and approximately 500 feet underground.

The highwall system includes a continuous miner followed by a combination articulated haulage/tramming conveyor (hereinafter "tramming conveyor") and a load-out and control vehicle (hereinafter "load-out vehicle") for transferring mined coal from the tramming conveyor to trucks or to another conveyor; for housing the equipment for controlling and monitoring the operation of the system and the electric power equipment. The rear end of the continuous miner is operatively connected to the inlet or inby end of the tramming conveyor by an arrangement which constantly measures (1) the distance between the rear end of the continuous miner and the inby end of the tramming conveyor and (2) the angle between the continuous miner discharge conveyor boom on the miner and the tramming conveyor. The upper portion of the tramming conveyor has a substantially U-shaped cross section with a bottom pan and spaced sidewalls. A continuous conveyor chain having spaced flights for transporting the mined coal from the inby end to the outby end extends along the upper surface of the bottom pan on the tramming conveyor. The tramming conveyor includes hydraulic jacks spaced along each edge for raising and lowering the conveyor relative to the ground. The edges of the tramming conveyor may be raised simultaneously or independently depending upon conditions in the mine such as the seam pitch. When the tramming conveyor is in the raised position, it is in the conveying mode to transport mined coal rearwardly to the load-out vehicle. When the tramming conveyor is lowered by retracting the hydraulic jacks until the chain on the return side contacts the ground or the mine floor, the conveyor is in the tramming mode for movement along the mine floor. In this regard, the outer edge of each chain flight is provided with outwardly extending lugs or studs to facilitate tramming the conveyor. Typically, the tramming conveyor will tram at approximately 55 feet per minute and convey at approximately 175 feet per minute.

The system provides substantially complete automation. An operating technician is located in the cab in the load-out vehicle which functions as the control center for the entire system as it houses the computer controls, the electric power equipment, the main power control, the hydraulic pump station, the power cable reel and the operating technician's work station with the computer readout information screens. Special electric controls made by Allen-Bradley are used to sequence the operation of the continuous miner, the tramming conveyor, and the load-out vehicle as mining progresses continuously into the hole. As mining progresses, information is provided to the screens in the load-out vehicle from a ring laser gyroscope, inclinometers and gamma detectors which monitor the operation of the continuous miner. In addition to the operating technician, a worker is available to supervise the loading of the mined coal into trucks or onto a conveyor.

Workers are not required at the entry end of the hole being mined which is an important safety feature in the event of a methane or a dust explosion within the hole. The only time a worker is required at the entry end of the hole is when the continuous miner is initially started to enter the highwall face.

The advantageous features of the system include a continuous ventilation tube which extends from the load-out vehicle throughout the length of the tramming conveyor and the continuous miner to provide either fresh air or an inert gas to the face being mined. A fan is located on the load-out vehicle to deliver the air or the inert gas through the ventilation tube to the face. The system is not subject to methane or dust explosions because methane and dust accumulation will be controlled by providing inert gas through the ventilating tube.

A safety feature included in the control system provides that, if the continuous miner shuts down for any reason, the movement of the tramming conveyor chain is immediately stopped so that the direction of travel of the chain can be reversed. The hydraulic jacks are retracted until the chain rests on the mine floor and movement of the chain is restarted to pull the tramming conveyor and the continuous miner rearwardly out of the hole.

The highwall mining system can operate with approximately 1,000 feet of tramming conveyor working in conjunction with a modified J 14 CM continuous miner manufactured by Joy Manufacturing Company located in Franklin, Pa., which has a boom with a center discharge conveyor for moving mined coal from the pan at the face to the rear end of the continuous miner. The boom for the discharge conveyor extends rearwardly past the rear end of the continuous miner and terminates above the receiving end of the tramming conveyor.

In operation, the system provides a substantially continuous method of mining rather than a remote controlled cyclical mining method. Continuous mining according to the method of the invention is accomplished by the computer operated controls which operate the system in response to preprogrammed instructions in accordance with conditions determined by continuously monitoring information provided by sensors on the continuous miner. The computers are programmed to sequentially operate the continuous miner to out, load and convey the mined coal. Thus, the rotating cutting head, which is pivotally mounted on the forward end of the pivotally mounted cutting head booms, sumps in at the top of the coal seam, shears downwardly through the seam, sumps in at the bottom of the seam and shears upwardly through the seam in a continuous sequential multiple step operation. This method of operation of the rotary cutting head continues until the continuous miner has advanced into the seam a preset distance from the inby end of the tramming conveyor. The preset distance of advance by the continuous miner is determined in accordance with the length of the boom for the discharge conveyor on the continuous miner in order to maintain an overlap of the outby end of the discharge conveyor on the continuous miner with the inby end of the tramming conveyor.

When the preset distance is reached, the outby end of the discharge conveyor on the continuous miner will be located substantially at the inby end of the tramming conveyor. At this point, the chain on the tramming conveyor must reverse its direction and tram forwardly to close the gap with the rear end of the continuous miner. This sequence of operation is repeated throughout the length of the hole. When the computer signals the tramming conveyor to tram forwardly toward the rear of the continuous miner, the discharge conveyor on the continuous miner is automatically stopped and the tramming conveyor continues to run in the conveying mode for a period sufficient to clear the inlet end of the top chain located in the hopper section to minimize spillage behind the continuous miner when the tramming conveyor is reversed to tram toward the rear end of the continuous miner. The computer then signals the tramming conveyor to retract the jacks and lower to the ground and tram forwardly until the inby end reaches the desired position close to the rear end of the continuous miner. The hydraulic jacks are then extended to raise the tramming conveyor into the conveying mode wherein mined coal is transported rearwardly to the load-out vehicle. As soon as the entire length of the tramming conveyor is raised off the ground by the hydraulic jacks, the continuous miner is started and mining continues.

A complete understanding of the invention will be obtained from the following description when taken in connection with the accompanying drawing figures wherein like reference characters identify like parts throughout.

DESCRIPTION OF THE PREFERRED EMBODIMENTS

Figure 2:
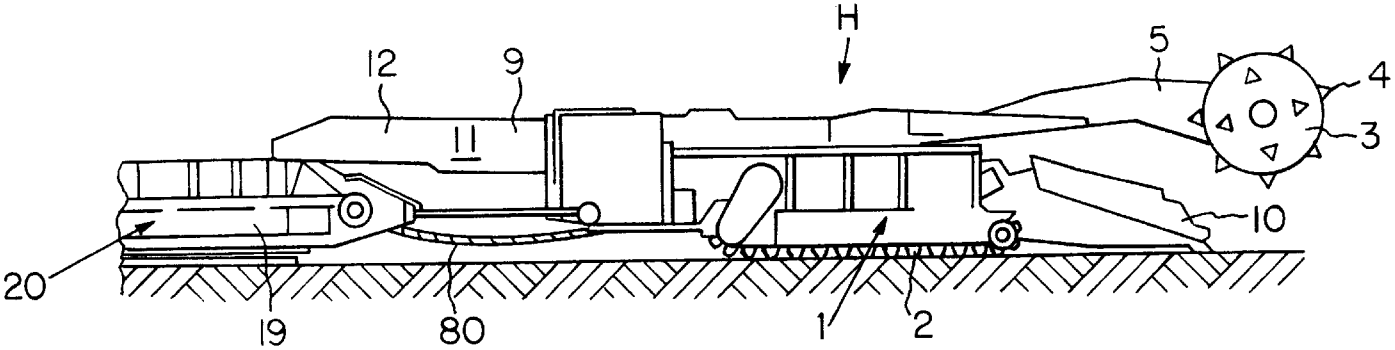
FIG. 2 is a schematic elevation of a portion of a highwall mining system.
Figure 1:
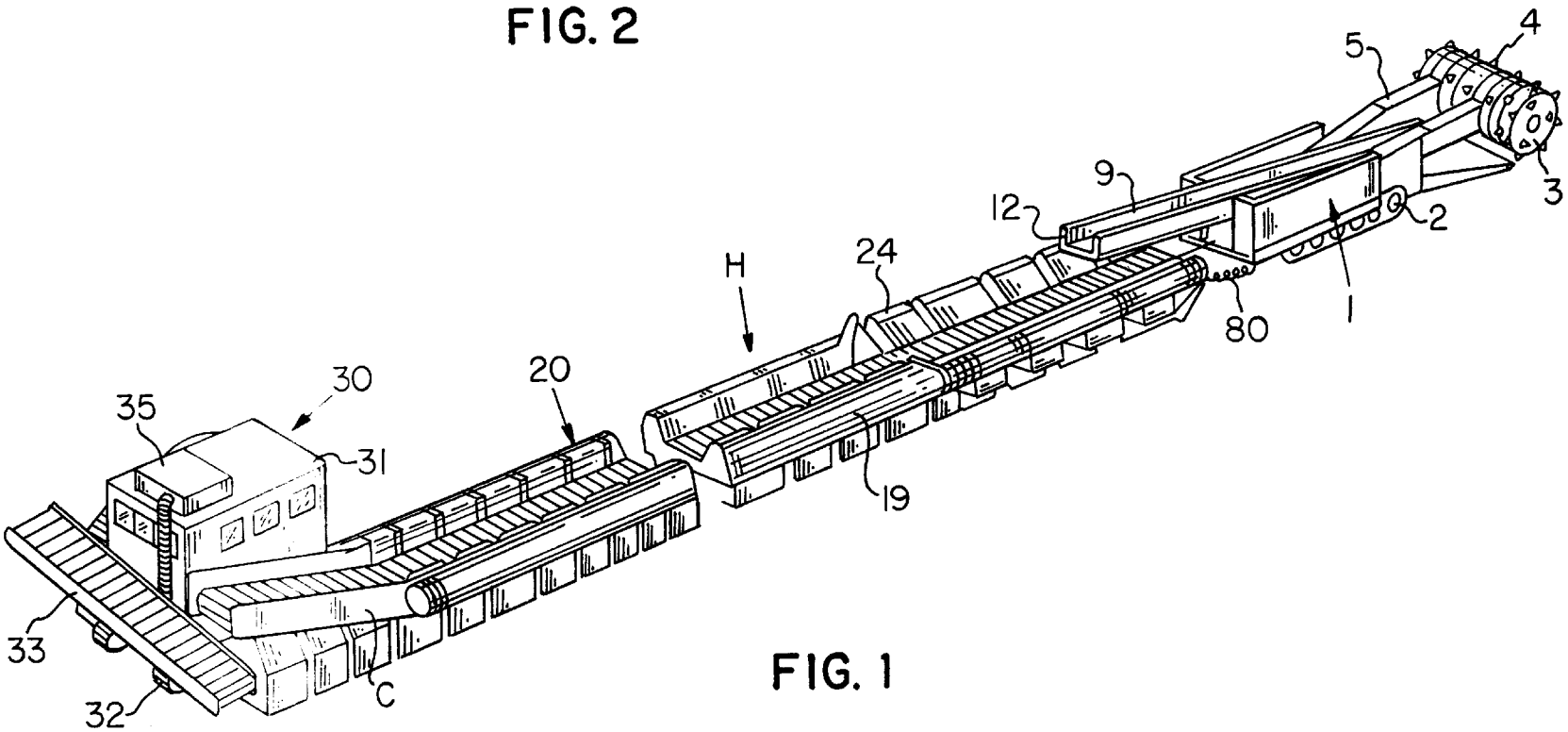
FIG. 1 is a broken perspective of a highwall mining system.
Figure 3:
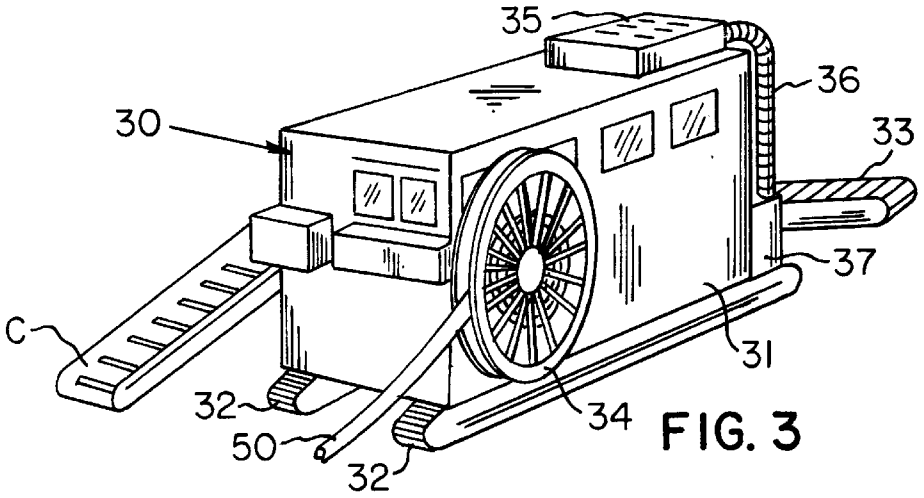
FIG. 3 is a perspective of the load-out vehicle.

FIGS. 1 and 2 of the drawings show a highwall mining system H including a continuous miner 1 mounted on crawlers 2 and having a rotary cutting head 3 with cutting bits 4 on the circumference and the ends thereof. The rotary cutting head is mounted on the distal ends of cutting head booms 5 which are pivoted to the frame of the continuous miner so that they can be raised and lowered to shear the complete vertical face of a coal seam at the inner end of a hole. The continuous miner is a J 14 CM manufactured by the Joy Manufacturing Company located in Franklin, Pa. with substantial modifications and additions according to the invention. However, other continuous miners may be used with appropriate modifications. A central discharge conveyor 9 extends rearwardly from a front end loading pan 10 to the rear end of a boom 11 extending beyond the rear end of the continuous miner. The rear end of central discharge conveyor 9 is located over hopper section 24 at the inby end of tramming conveyor 20. The mined coal on loading pan 10 of continuous miner 1 is moved onto central discharge conveyor 9 by a plurality of rotating sweep arms which are well-known to those skilled in the art. The central discharge conveyor transports the coal to the hopper section of tramming conveyor 20 which transports the coal rearwardly out of the hole.

Figure 4:
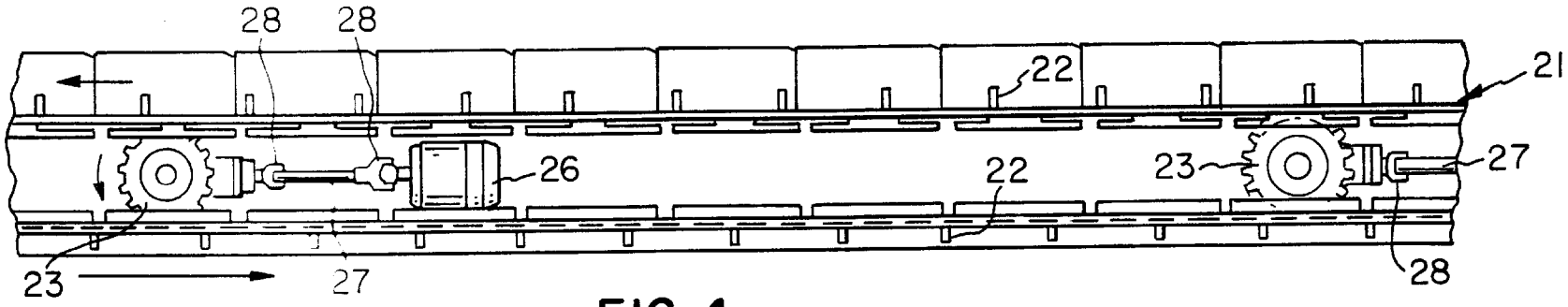
FIG. 4 is a schematic side elevation of a portion of the tramming conveyor.
Figure 5:
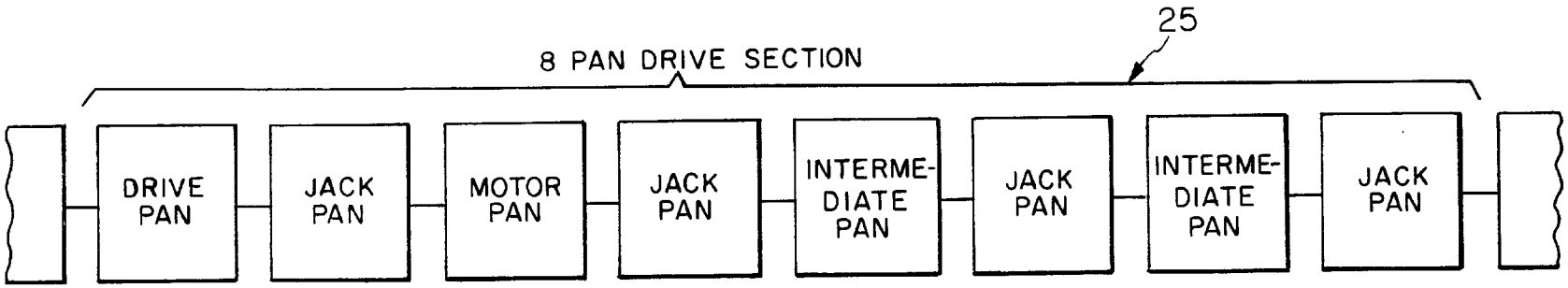
FIG. 5 is a schematic of an eight pan section of the tramming conveyor.

Tramming conveyor 20 has a continuous chain 21 with spaced flights 22. The chain is moved along the conveyor pan by electric motor driven sprockets 23 to transport mined coal rearwardly out of the hole when the tramming conveyor is in the raised position ("conveying mode") shown in FIG. 6 of the drawings. When the tramming conveyor 20 is in the lower position ("tramming mode") shown in FIG. 7 of the drawings, it trams along the mine floor as determined by the direction of travel of chain 21. The length of the tramming conveyor is determined by the distance between the face of the coal seam and the location of load-out vehicle 30. The tramming conveyor has a plurality of eight pan drive sections 25 as shown in FIGS. 4 and 5 of the drawings. A single drive section is described in detail hereinafter. As shown in FIG. 1 of the drawings, the tramming conveyor has a hopper section 24 at the inby end which has high angled side walls in order to contain the mined coal which is deposited on chain 21 by central discharge conveyor 9 on continuous miner 1. This hopper section supplies the mined coal to the rearwardly located sections of the tramming conveyor for continuous transport away from the continuous miner to load-out vehicle 30. As will be understood by those skilled in the art, the hopper section and the other sections of tramming conveyor 20 accept continuous chain 21 which is moved along the conveyor pan by spaced sprockets 23 which are driven by electric motors 26 in accordance with the arrangement shown in FIG. 4 of the drawings.

With reference to FIG. 4, each electric drive motor 26 is connected to one end of a drive shaft 27 by a universal joint 28. The opposite end of each drive shaft is connected to a sprocket 23 by a second universal joint 28 to rotate the sprocket. The chain is provided with spaced flights 22 and lugs or studs 29 extend outwardly from the outer edge of each flight to provide traction during tramming.

As shown in FIG. 5 of the drawings, each eight pan drive section includes a drive pan at one end containing a sprocket 23. A jack pan having hydraulic jacks is located adjacent to the drive pan, and a motor pan is located adjacent the other side of the jack pan. Drive shaft 27 which extends from motor 26 on the motor pan to sprocket 23 on the drive pan passes over the jack pan. A second jack pan is located on the opposite side of the motor pan and an intermediate pan is located adjacent to the jack pan. A second combination of a jack pan and an intermediate pan is located downstream of the intermediate pan, and another jack pan is located adjacent to the intermediate pan. As is apparent, every alternate pan in the section is a jack pan having the hydraulic jacks for raising and lowering tramming conveyor 20.

The load-out vehicle 30 is located at the outby end of tramming conveyor 20 and includes an operator cab 31 mounted on caterpillar tracks 32. The controls and computer screens are all located at the operator station in cab 31 so that they can be constantly monitored by the operator. Load-out vehicle 30 includes an outlet conveyor C on one side for transmitting mined coal from the outby end of tramming conveyor 20 onto a transverse conveyor 33 located perpendicular to the tramming conveyor and the outlet conveyor for transporting the coal laterally into trucks or onto a stationary belt conveyor (not shown). The load-out vehicle also supports electric power transformers, a cable reeler 34 which carries coils of power cable bundle 50 and maintains the cable relatively taut while the tramming conveyor and the continuous miner move relative to the load-out vehicle. As explained hereinafter, the end of the power cable bundle at the continuous miner is maintained under tension to minimize the sag in the cable between continuous miner 1 and trailing tramming conveyor 20.

The load-out vehicle includes a blower (not shown) located in a housing 35 on the roof which blows cooling air downwardly through a conduit 36 to a main transformer housing 37 located in the lower portion of the vehicle. It has been determined that this cooling air is essential to maintain the main electric power transformers at a sufficiently low temperature to permit substantially continuous operation of the transformers.

Figure 6:
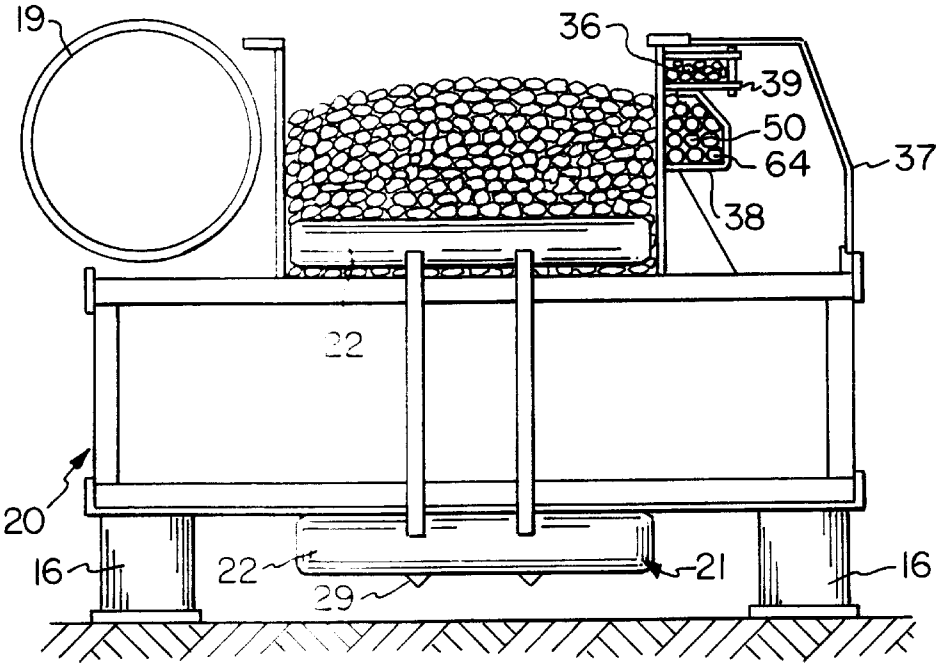
FIG. 6 is a vertical section through the tramming conveyor in the conveying mode.
Figure 7:
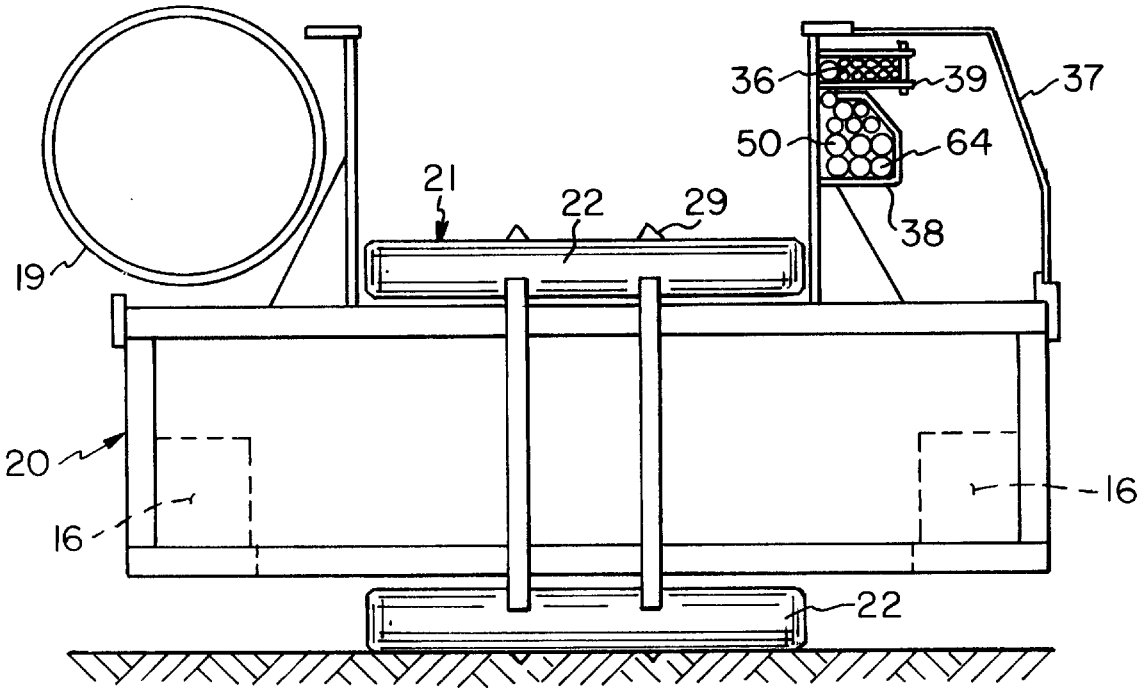
FIG. 7 is a vertical section through the tramming conveyor in the tramming mode.

Power cable bundle 50, the data communication cable bundle 36 and cooling fluid conduits 64 are shown in FIGS. 6 and 7 of the drawings as passing, respectively, through support and clamping brackets 38 and 39 located within housings 37 on tramming conveyor 20 to protect the cables and conduits from accidentally being cut as mining progresses.

Figure 8:
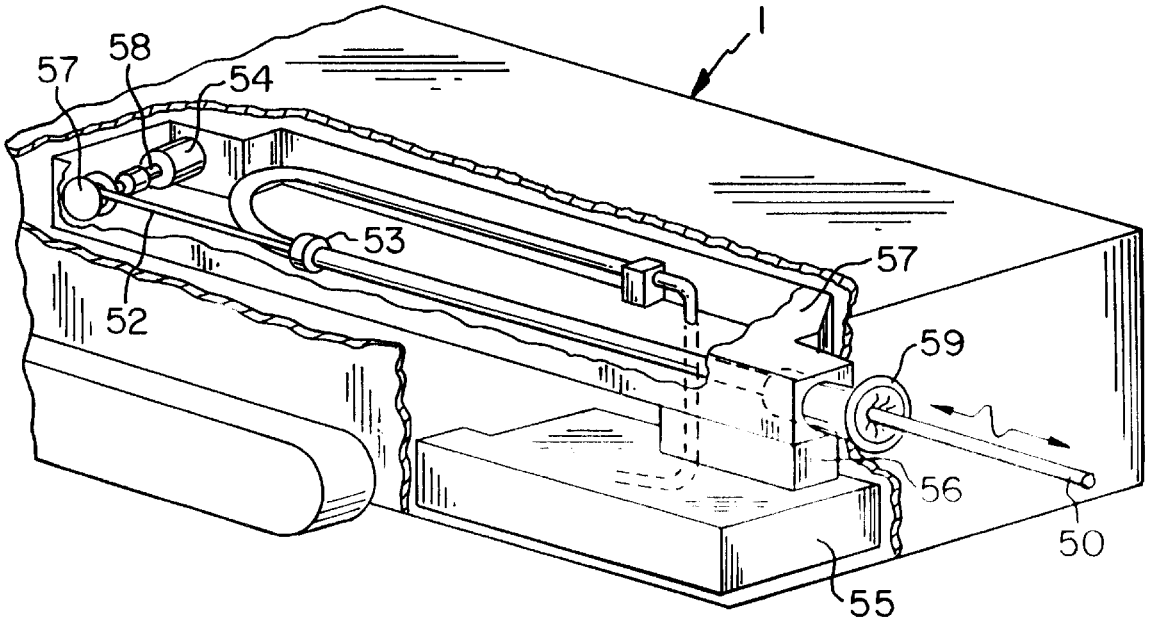
FIG. 8 is a broken perspective of a rear corner of the continuous miner.

The end of power cable bundle 50 opposite cable reeler 34 extends into a coffin box 51 located on the left rear corner of continuous miner 1 above a water cooled electrical control housing 55 as shown in FIG. 8 of the drawings. The power cable follows a U-shaped path in the coffin box returning toward the rear end of the continuous miner where it is directed downwardly through a chimney 56 into control housing 55 for connection to the controls for the continuous miner. The chimney has removable side panels to provide access to the power cable terminals located therein. The portion of power cable 50 located within coffin box 51 is attached to one end of an inelastic tension wire 52 by a retaining collar 53. The other end of inelastic tension wire 52 is connected to a take-up reel 57 mounted on a drive shaft 58. Tension on wire 52 is maintained by a constant torque hydraulic motor 54 which drives shaft 58 of take-up reel 57. The tension on wire 52 is transmitted to the end portion of power cable bundle 50 to prevent the power cable from lying on the ground between continuous miner 1 and tramming conveyor 20 where it could be cut during movement of the tramming conveyor. The entry opening into coffin box 51 is provided with an elastic seal 59 to prevent dust and dirt from entering the coffin box.

Figure 11:
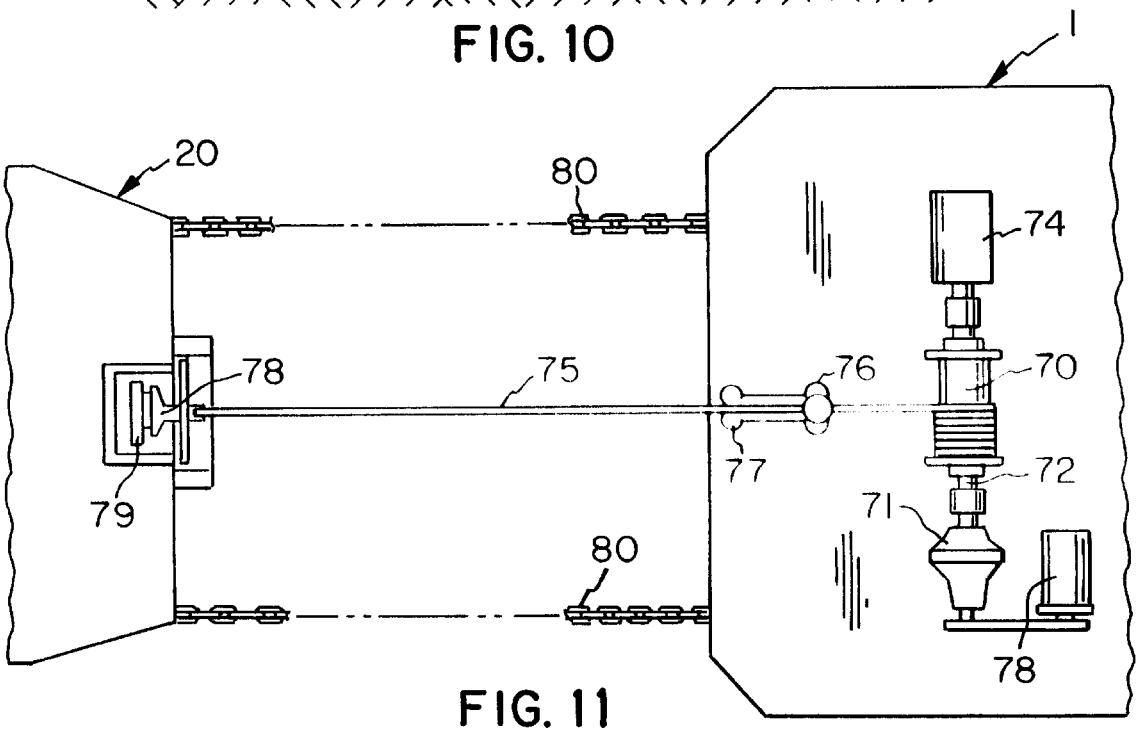
FIG. 11 is a schematic plan of the connections between the rear end of the continuous miner and the inby end of the tramming conveyor.

FIG. 11 of the drawings shows a distance measuring arrangement extending between the rear end of continuous miner 1 and the inby end of tramming conveyor 20. Additionally, tramming conveyor 20 is steered from the continuous miner to maintain the desired angle between the discharge conveyor boom on the continuous miner and the tramming conveyor. The continuous miner carries a rotatable drum 70 which is connected to a speed reducer 71 by a rotary shaft 72 which is driven by a hydraulic motor 73. A distance measuring motor or rotary encoder 74 is also supported on rotary shaft 72. A wire rope 75 extends from drum 70 through a dashpot indicator 76 which is in alignment with the pivot for conveyor boom 11 to determine the angle of conveyor boom 11 relative to the tramming conveyor. Wire rope 75 also extends through vertical and horizontal wire rope guides 76 and horizontal pivoting guides 77 which are mounted on an arm extending from the dashpot. The signals from the dashpot are transmitted to the controls in the cab of the load-out vehicle.

The opposite end of wire rope 75 is connected to a microswitch 79 on tramming conveyor 20 by a toggle block 78 to control steering hydraulic cylinders (not shown) for the tramming conveyor. Thus, the length of wire rope 75 controls the distance between the rear end of continuous miner 1 and the inby end of tramming conveyor 20. A pair of safety chains 80 are connected between the rear end of continuous miner 1 and the inby end of tramming conveyor 20 to insure that the gap between the rear of the continuous miner and the tramming conveyor does not exceed a preset distance which would result in broken cables and conduits.

Figure 9:
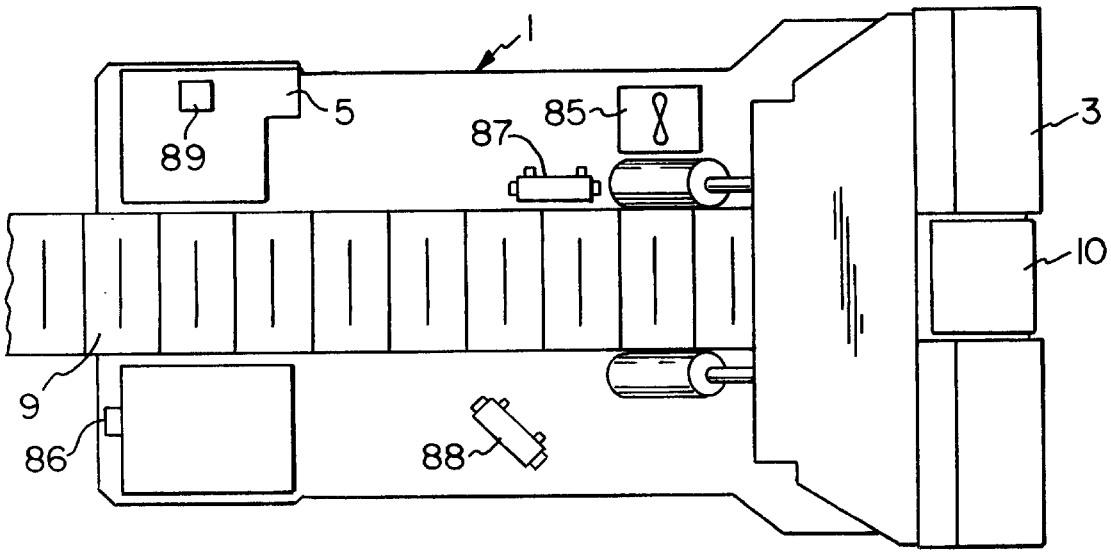
FIG. 9 is a schematic plan of the continuous miner.
Figure 10:
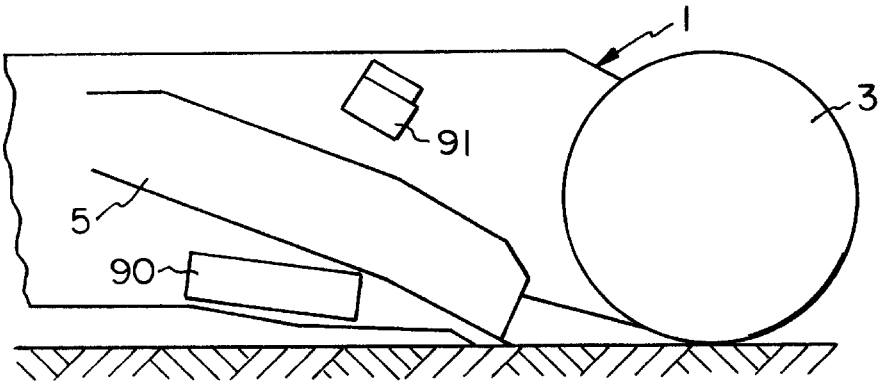
FIG. 10 is a schematic elevation of one side of the front end of the continuous miner showing gamma ray sensors.

FIG. 9 of the drawings shows the continuous miner with an onboard exhaust fan 85 for exhausting dust and methane from the area adjacent to the coal face. Ventilation air passes to continuous miner 1 through the ventilation tube 19 and control box 55 is shown at the left-hand rear corner of the continuous miner. A radio receiver 86 is shown at the rear of the continuous miner and heat exchangers 87 and 88 for the continuous miner hydraulic system are located forwardly of the control housing. The control box includes a temperature measurement device 89 to ensure that the temperature does not exceed a preselected maximum.

The automatic operation of the highwall mining system, including the continuous miner, the tramming conveyor, and the load-out vehicle, is controlled by a computer processor-based system distributed throughout the miner, the tramming conveyor and the load-out vehicle. Additional arrangements are provided to enhance the operation, safety and reliability of the mining system. The control scheme and other elements in the mining system are based on the primary goal of recovering the system if something does go wrong while the continuous miner and the tramming conveyor are in a hole. Also, normal continuous operation of the mining system requires only a single operator in load-out vehicle 30, which is located on the bench out of the hole in a highwall mining operation. The controls for the highwall mining system are illustrated in FIGS. 12–18, with continued reference to FIGS. 1–11 discussed above.

As discussed above in connection with FIGS. 4 and 5, articulated tramming conveyor 20 has a plurality of pivotally connected drive sections. Each drive section has eight connected pans including an electric motor, located in a motor pan, which drives a conveyor drive sprocket located in a drive pan. Electrical power is supplied to the electric motor in each drive section, and rather than rely upon a single power line to supply the electrical power for all of the drive motors and lose the ability to move the tramming conveyor if the single power supply is lost, the invention includes a distributed power supply having a plurality of separate power lines which supply separate drive motors located in the different drive sections. It is preferred that each electrical power line supply power to electric motors in spaced apart, separate drive and non-sequential sections along the length of the tramming conveyor, preferably evenly spaced along the length of the tramming conveyor. In this manner, if one or more electric power lines is lost, with an attendant loss of power to some of the electric drive motors, the tramming conveyor will still have sufficient operating drive motors spaced along its length. Even with only a fraction of the drive motors receiving electric power, tramming conveyor 20 can be trammed out of the hole for inspection and repair.

Figure 12:
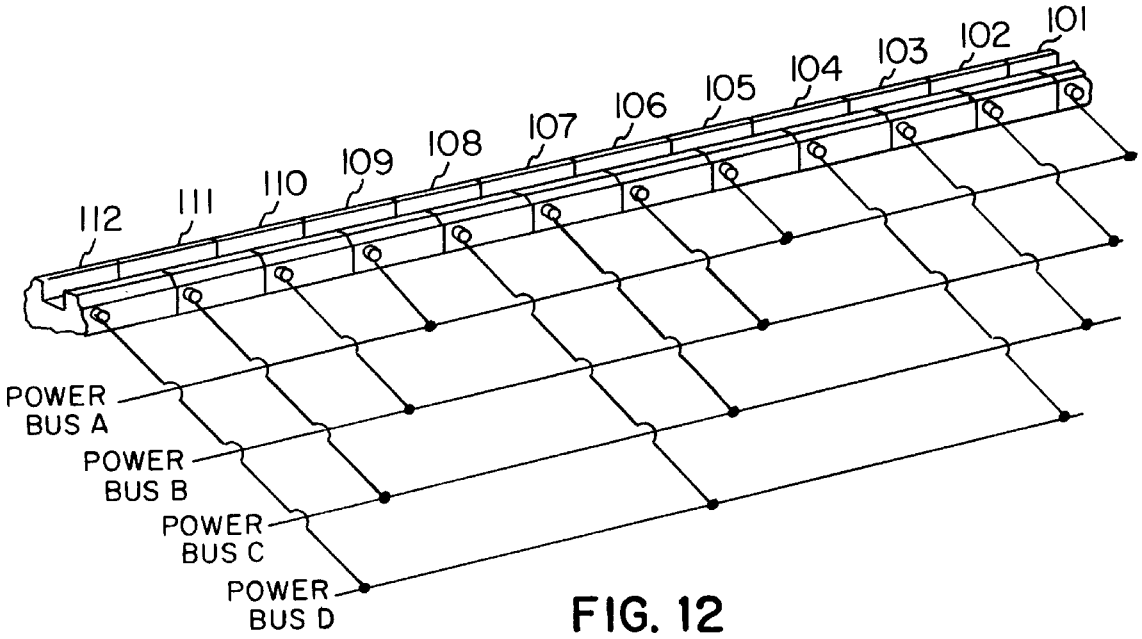
FIG. 12 is a schematic diagram of the power distribution system for the tramming conveyor drive motors.

Although any number of separate power lines greater than a single line can be provided, the embodiment shown in FIG. 12 of the drawings includes four separate and independent power lines identified as power bus A, power bus B, power bus C, and power bus D. Each of the four power lines supplies operating power to one-fourth of the drive motors. As shown, each power line is connected to the drive motor in every fourth drive section along the length of the conveyor. FIG. 12 shows only a small length of the tramming conveyor including twelve drive sections identified by reference numbers 101 through 112. As shown, power bus A is connected and supplies electrical power to the drive motor in the first, fifth and ninth drive sections 101, 105 and 109, respectively. Similarly, power bus B is connected to and supplies electrical power to the second, sixth and tenth drive sections 102, 106 and 110, respectively; power bus C is connected to and supplies electrical power to the third, seventh and eleventh drive sections 103, 107 and 111, respectively; and power bus D is connected to and supplies electrical power to the fourth, eighth and twelfth drive sections 104, 108 and 112, respectively. This distribution of the power lines and connections to the drive motors in every fourth drive section is repeated throughout the length of tramming conveyor 20.

Figure 13:
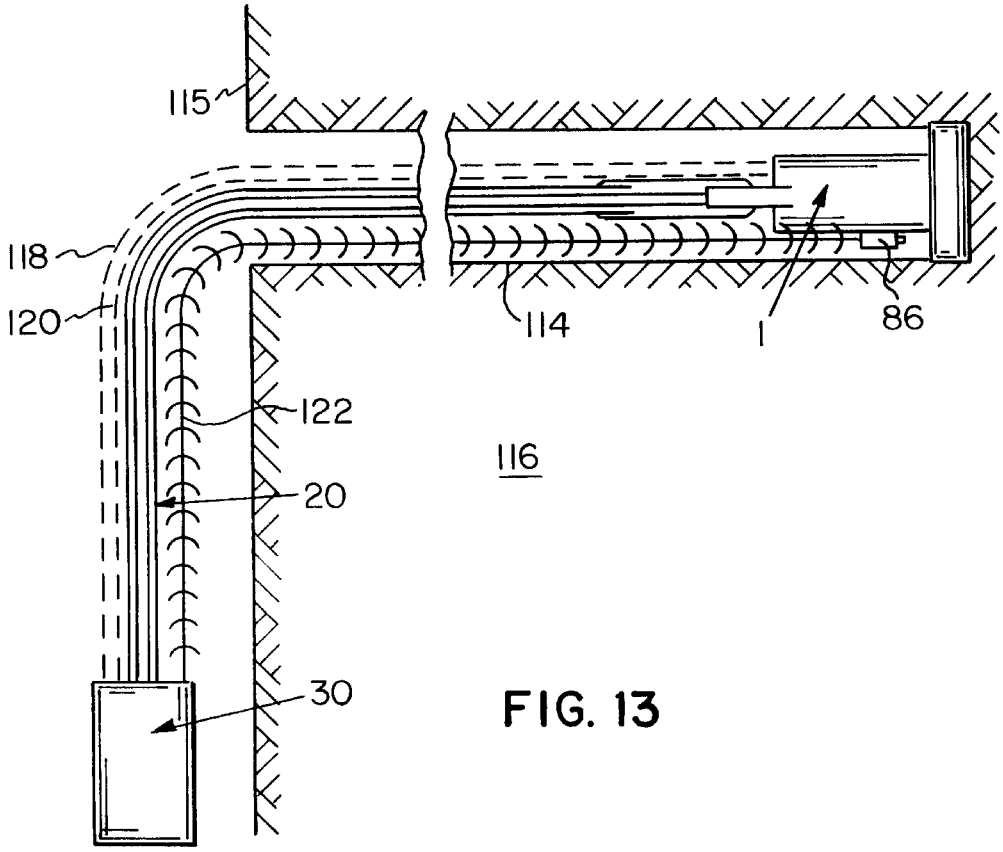
FIG. 13 is a schematic plan of the data communication highways in the mining system.

The automatic operation and computer control features of the present invention are illustrated in connection with FIGS. 13–18 of the drawings. FIG. 13 illustrates a highwall mining operation. From the initial formation of hole 114 through highwall 115 in the coal or other mineral seam 116, the continuous miner is located underground and becomes progressively more difficult to reach if problems develop. As the continuous miner progresses into coal seam 116, more and more of the tramming conveyor extends along the length of and is enclosed within hole 114. The load-out vehicle is always located out of hole 114, beyond highwall 115, in a readily accessible location. The main focus of the control system of the present invention is to include redundancy where appropriate, to provide safety backups, and to physically locate the computers and control programs in appropriate areas. While the continuous miner has, as discussed hereinafter in more detail, its own computer physically located thereon for control of the miner and other aspects of the system, other computers are located in cab 31 on load-out vehicle 30 and at the rear of tramming conveyor 20 in normally accessible locations. Data communication between the computer on the continuous miner and the other computers is provided by a pair of parallel, hardwired data highways, referred to as a primary or first data highway 118 and a secondary backup data highway 120. In addition, a coaxial cable 122 extends from the load-out vehicle, along the tramming conveyor, to a video camera (not shown) located on the forward portion of continuous miner 1. This coaxial cable 122 is normally used to provide the operator in the load-out vehicle with a means for visually inspecting the mining operation. As discussed hereinafter in more detail, if either of the first or second data highways 118 or 120 fail, radio control signals can be sent into hole 114 and propagate along coaxial cable 122, which provides a transmission path to a radio receiver 86 on the continuous miner. The physical location of radio receiver 86 on the continuous miner is shown in FIG. 9. This additional backup data communication system permits the use of a hand-held radio controller for providing manual control signals to the mining system.

Figure 14:
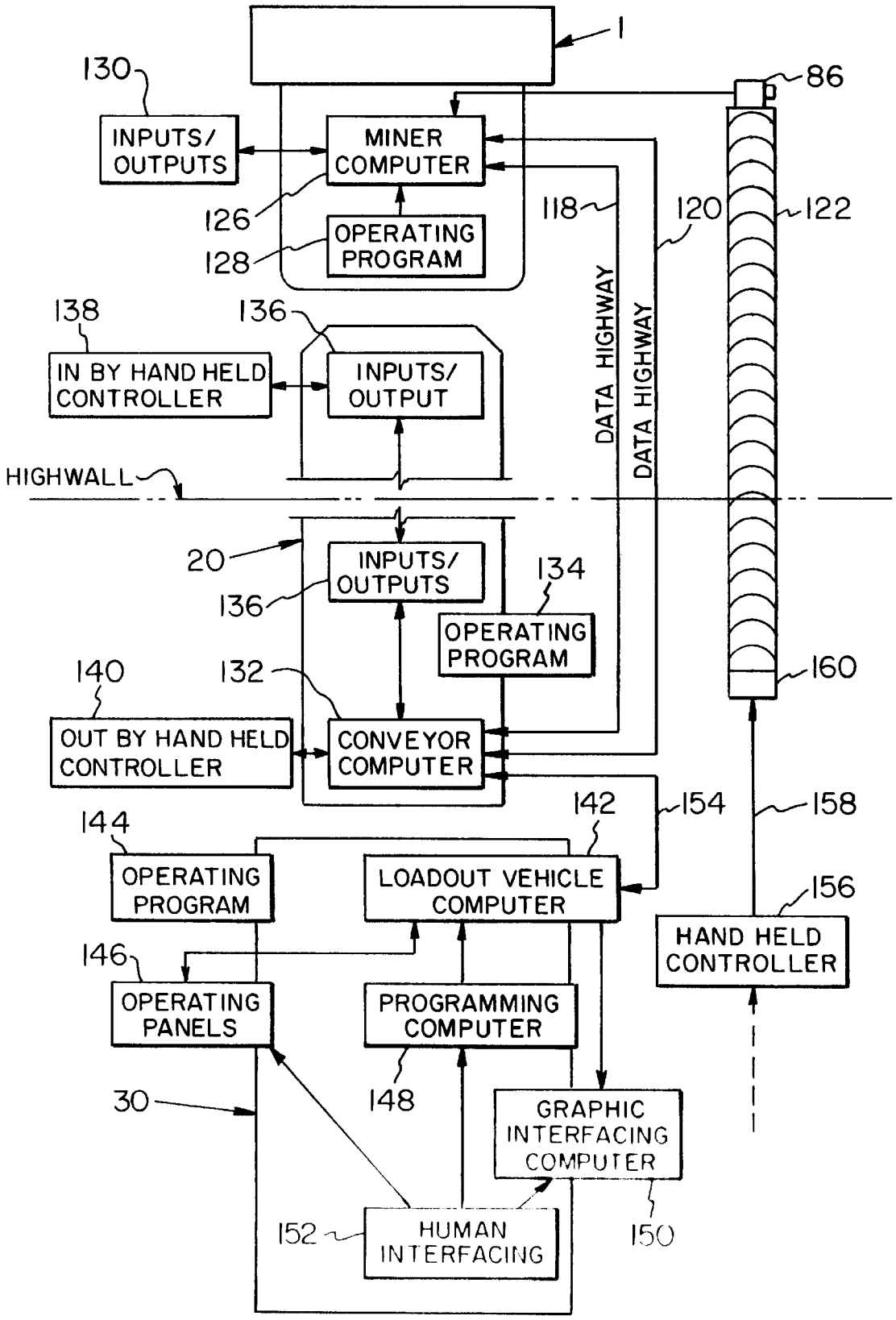
FIG. 14 is a schematic diagram of the computer control portion of the mining system.

The arrangement of the computers and data flow paths of the overall system is shown in FIG. 14 of the drawings. The continuous miner has a miner computer 126 along with a stored operating program 128 for miner computer 126 located thereon. Miner computer 126 is used to control a number of inputs and outputs 130 associated with the continuous miner. The tramming conveyor also includes a conveyor computer 132 along with an associated operating program 134. Similar to miner computer 126, conveyor computer 132 controls a number of inputs and outputs 136 along the length of tramming conveyor 20. An inby hand-held controller 138 can provide direct, manual control of the inputs and outputs 136 on the tramming conveyor, and an outby hand-held controller 140 can communicate with the conveyor computer 132 and provide manual control of the inputs and outputs 136 on the tramming conveyor. The first or primary data highway 118 extends between miner computer 126 and conveyor computer 132. Similarly, the second or backup data highway 120 extends between miner computer 126 and conveyor computer 132. Load-out vehicle 30 includes its own computer 142 along with an associated operating program 144.

The load-out vehicle also includes operating panels 146, a programming computer 148 and a graphic interfacing computer 150, each receiving data from and/or supplying data to load-out vehicle computer 142. Operating panels 146, programming computer 148 and graphic interface computer 150 are controlled by a load-out vehicle operator or a computer technician referred to as "human interfacing" 152 in FIG. 14. The programming computer 148 is used only for initial programming of the operating programs (128, 134 and 144) and computers (126, 132 and 142) on continuous miner 1, tramming conveyor 20, and load-out vehicle 30 and is not used thereafter in controlling the normal operation of the highwall mining system. Two-way data flow path 154 is provided between conveyor computer 132 and load-out vehicle computer 142. Since the load-out vehicle is under control of a human operator, through operating panels 146, a hand-held controller is not needed to control the load-out vehicle. However, hand-held controller 156, including extended antenna 158 and radio transmitter 160, provides optional control communication along coaxial cable 122 to radio receiver 86 located on the continuous miner as discussed above. Radio receiver 86 provides control signals directly to miner computer 126.

Figure 15A:
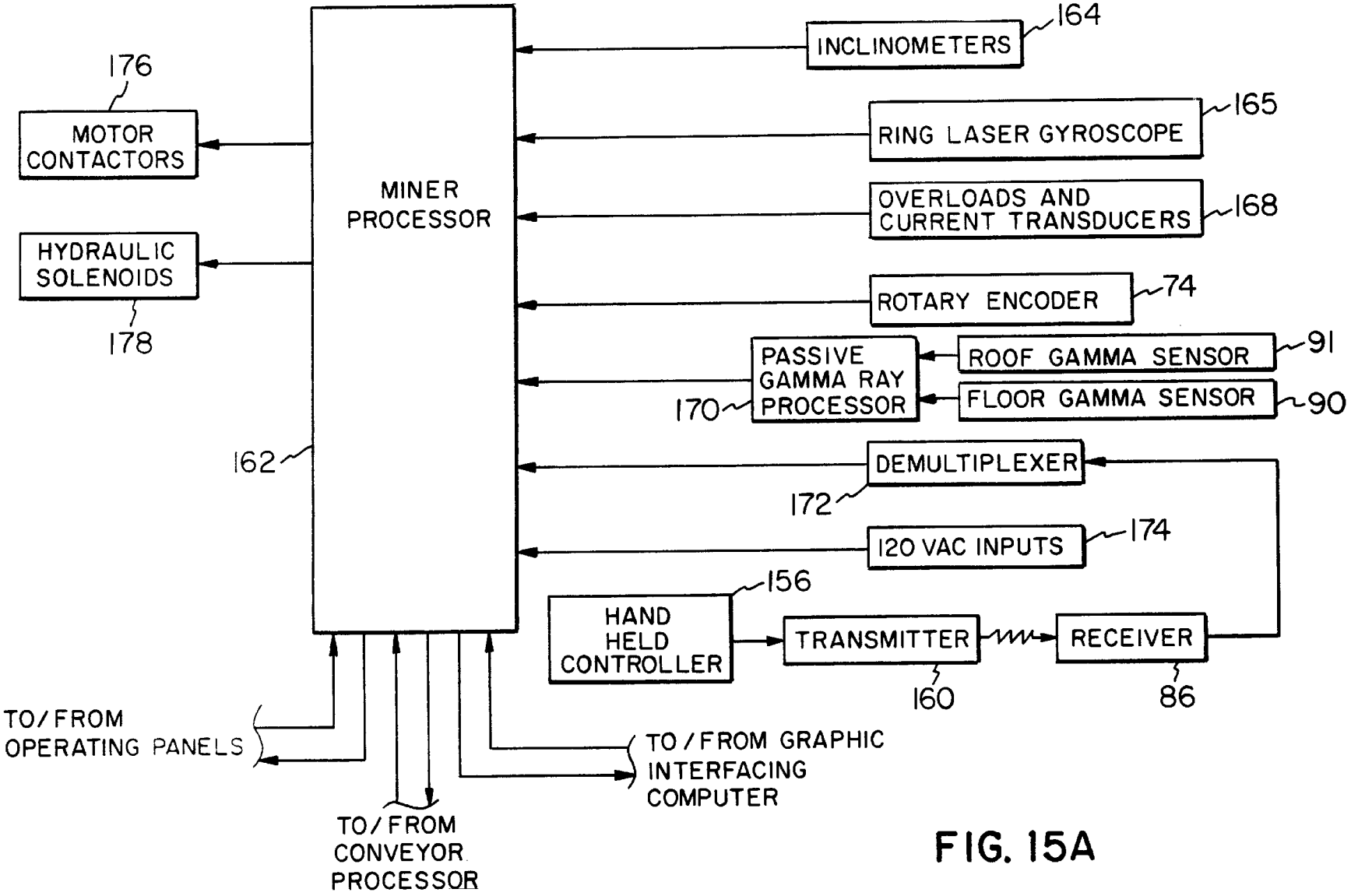
FIGS. 15A and 15B are block diagrams showing the details of the processors in the computer control system shown in FIG. 14.
Figure 15B:
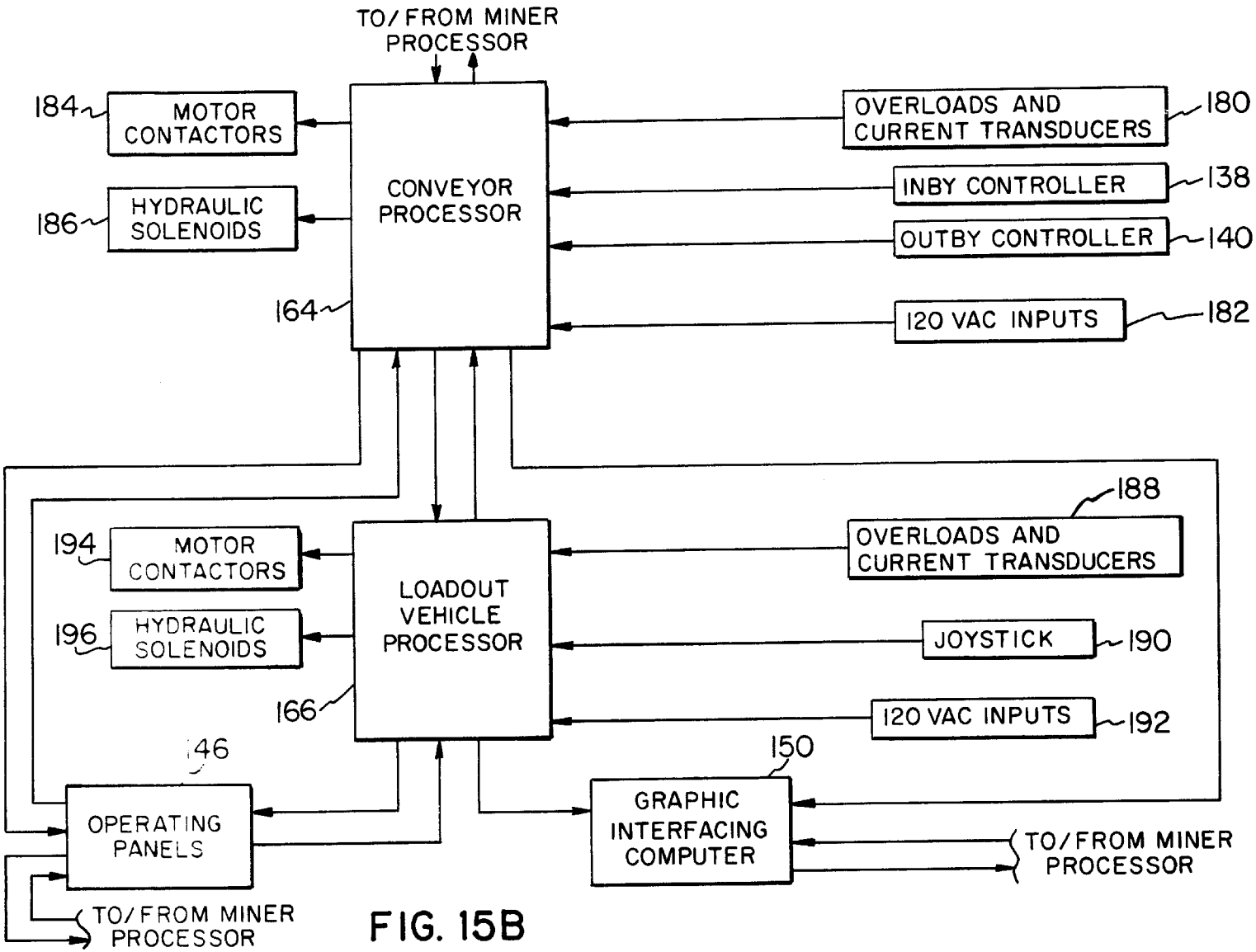

Details on the inputs supplied to and outputs controlled by miner computer 126, conveyor computer 132 and load-out vehicle computer 142 are shown in FIGS. 15A and 15B of the drawings. For convenience, miner computer 126 and its associated operating program 128 shown in FIG. 14 are referred to collectively as a miner processor 162 in FIG. 15A. Similarly, conveyor computer 132 and its associated operating program 134 in FIG. 14 are referred to collectively as a conveyor processor 164 in FIG. 15B and load-out vehicle computer 142 and its associated operating program 144 are referred to collectively as a load-out vehicle processor 166 in FIG. 15B. Processors 162, 164 and 166 can be Allen Bradley programmable logic controllers or other commercially available processors.

Referring to FIG. 15A, inclinometers 163 provide signals on relative machine position to miner processor 162. These inclinometers 163 provide readings on body pitch, body roll, cutter head, cutter head offset and gathering pan positions. Ring laser gyroscopes 165 mounted on the continuous miner provide azimuth and position signals to miner processor 162. Various overload sensors and current transducers 168 on the continuous miner provide information on the motor status to miner processor 162, including information on the cutter motors, gathering head motors, traction motors, hydraulic motor and ventilation fan motor. A rotary encoder or distance measuring motor 74 on the continuous miner provides a signal to miner processor 162 on the distance between the rear end of the continuous miner and the inby end of the tramming conveyor. The location of rotary encoder 74 on the continuous miner is shown in FIG. 11 of the drawings. A roof gamma ray sensor 91 and a floor gamma ray sensor 90 shown in FIG. 10 of the drawings provide signals to a passive gamma ray processor 170 which, in turn, provides signals on the location of the roof and the location of the floor to miner processor 162. These signals are used to keep the continuous miner properly positioned within the coal seam during normal operation. A radio receiver 86 on the continuous miner receives radio wave signals from transmitter 160 connected to hand-held controller 156 as described above. The radio wave signals received by the radio receiver are processed by a demultiplexer 172 which supplies control signals to miner processor 162. Various 120 volt AC input signals 174, also referred to as housekeeping signals from the continuous miner, are supplied to miner processor 162 to give information on emergency stops, machine status and the like. The continuous miner also receives information from conveyor processor 164, operating panels 146 and graphic interface computer 150.

As a result of all of the information supplied to miner processor 162 and in accordance with the program stored therein, output signals are supplied to various motor contactors 176 and hydraulic solenoids 178 on the continuous miner. The motor contactors 176 supply electrical power to and control cutter motors, miner conveyor motors, miner tram motors, a hydraulic motor and ventilation fan motors along tube 19. Hydraulic solenoids 178 supply hydraulic fluid to and control the cutter head, gathering head, conveyor boom and stab shoe. In addition, miner processor 162 supplies data to conveyor processor 164 as well as to operating panels 146 and to graphic interface computer 150.

Referring now to FIG. 15B of the drawings, conveyor processor 164 receives signals from overload sensors and from current transducers 180 which reflect the status of the drive motors and ventilation fan motors along the length of tramming conveyor 20. In addition, when operating in a manual mode, conveyor processor 164 receives and responds to control signals from inby hand-held controller 138 or outby hand-held controller 140. Various 120 volt AC inputs 182, referred to as housekeeping signals from the conveyor, supply information on emergency stops, machine status and the like to the conveyor processor. Conveyor processor 164 also receives information from miner processor 162, operating panels 146, and load-out vehicle processor 166.

As a result of all of the information supplied to conveyor processor 164 and in accordance with the program stored therein, output signals are supplied to various motor contactors 184, which supply electrical power to and control the drive motors and ventilation fan motors along the length of the tramming conveyor. In addition, conveyor processor 164 supplies output signals to hydraulic solenoids 186 which supply hydraulic fluid to control the steering pistons, a transmission shift, and hydraulic jacks 16 located along the length of tramming conveyor 20. Also, conveyor processor 164 supplies control signals to miner processor 162, graphic interface computer 150, load-out vehicle processor 166 and operating panels 146.

With continued reference to FIG. 15B of the drawings, load-out vehicle processor 166 receives signals from overload sensors and current transducers 188 which reflect the status of its conveyor motors, hydraulic motor and power center motor. In addition, a joy stick 190 on load-out vehicle 30 supplies a tramming control signal to load-out vehicle processor 166. Various 120 volt AC input signals 192, also referred to as housekeeping signals from the load-out vehicle, are supplied to load-out vehicle processor 166 to give information on emergency stops, machine status and the like. Load-out vehicle processor 166 also receives control signals from conveyor processor 164 and, through the operating panels 146, from miner processor 162.

As a result of these signals and the program stored therein, load-out vehicle processor 166 generates output signals which are supplied to motor contactors 194 which supply electrical power to and operate the conveyor motors, hydraulic motor and power distribution center fan on load-out vehicle 30. In addition, load-out vehicle processor 166 supplies output signals to hydraulic solenoids 196, which supply hydraulic fluid to and control the tram, diverter gate, cab level, and conveyor raising and lowering mechanisms on the load-out vehicle. Load-out vehicle processor 166 also supplies control signals to operating panels 146 and to graphic interface computer 150.

With the processor arrangement described above, the mining system of the invention, including the continuous miner, tramming conveyor and load-out vehicle, can be used to mine coal and move the mining equipment along a hole or back out of the hole in accordance with one or more various modes of operation, as dictated by either the human operator or by certain automatic controls. In the automatic mining mode of operation, which is the intended normal operation of the system, the continuous miner will continuously move along the coal seam in a particular path and convey the mined coal to the tramming conveyor which will, in the conveying mode of operation, move the coal along the length of the hole to the load-out vehicle. The distance measuring step motor or rotary encoder 74 on the continuous miner will continuously indicate the spacing between the rear end of the continuous miner and the inby end of the tramming conveyor. When the spacing becomes too great, the tramming conveyor shifts to the tramming mode of operation wherein the conveyor stops moving coal and trams the conveyor toward the rear end of the continuous miner, at which point the conveying mode commences.

Figure 16:
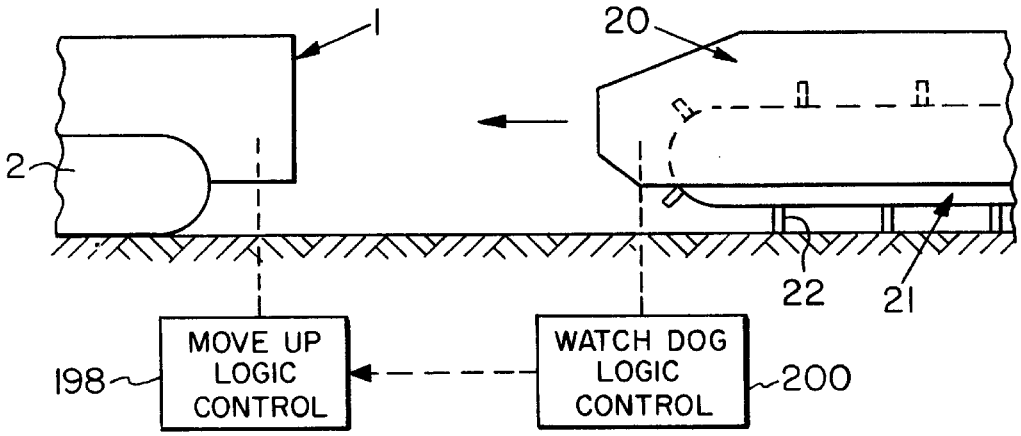
FIG. 16 is a schematic diagram of the miner/tramming conveyor spacing controls.

Referring to FIG. 16 of the drawings, as certain move up logic 198 in miner processor 162 determines that the inby end of tramming conveyor 20 has reached the maximum preselected distance from the rear end of the continuous miner, miner processor 162 sends a control signal to conveyor processor 164 which initiates the tramming mode of operation of the tramming conveyor. Watchdog logic 200 in conveyor processor 164 will double check the position information supplied from miner processor 162 to insure that tramming conveyor 20 does not run into the rear end of continuous miner 1.

Figure 17:
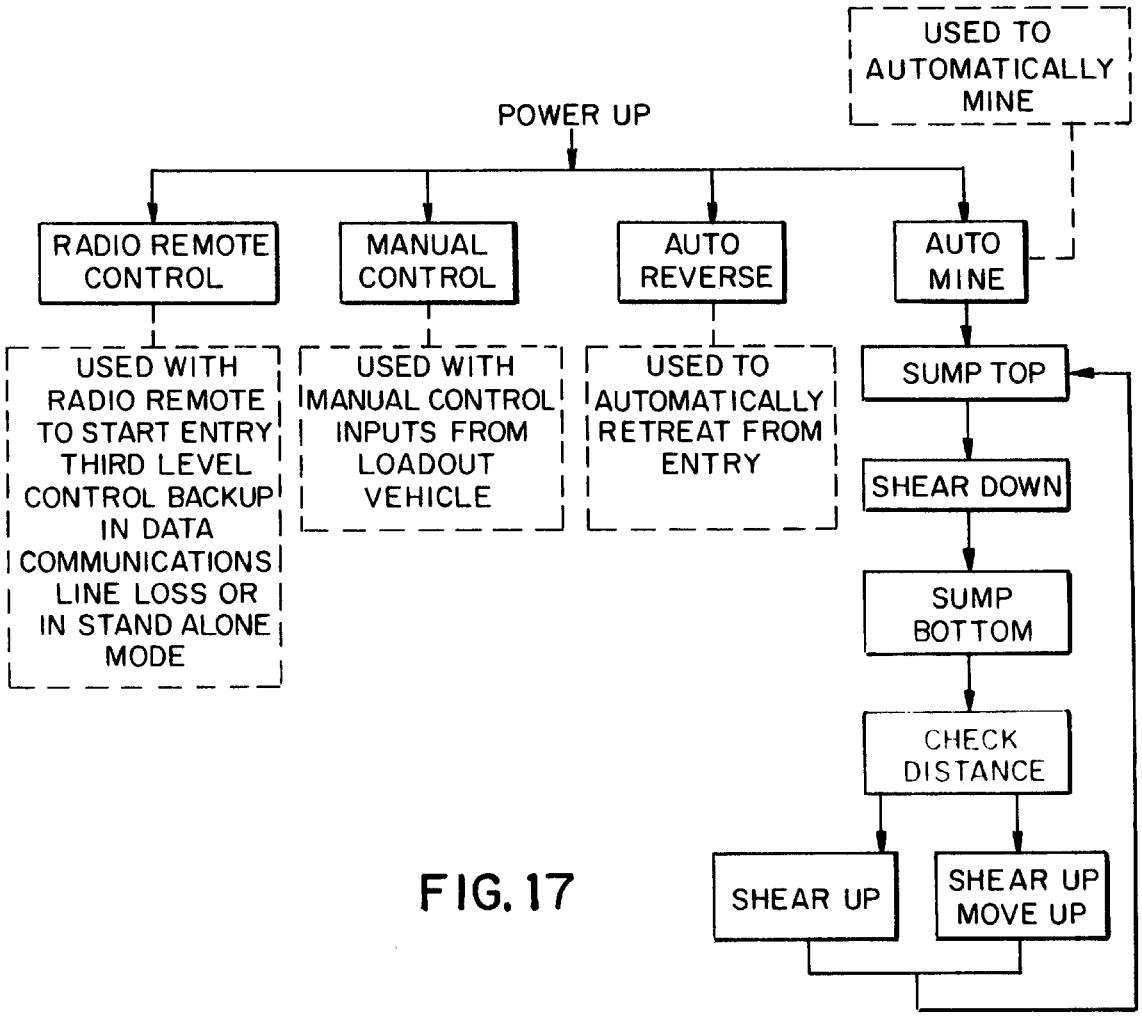
FIG. 17 is a flow diagram for the overall operation of the continuous miner processor.
Figure 18:
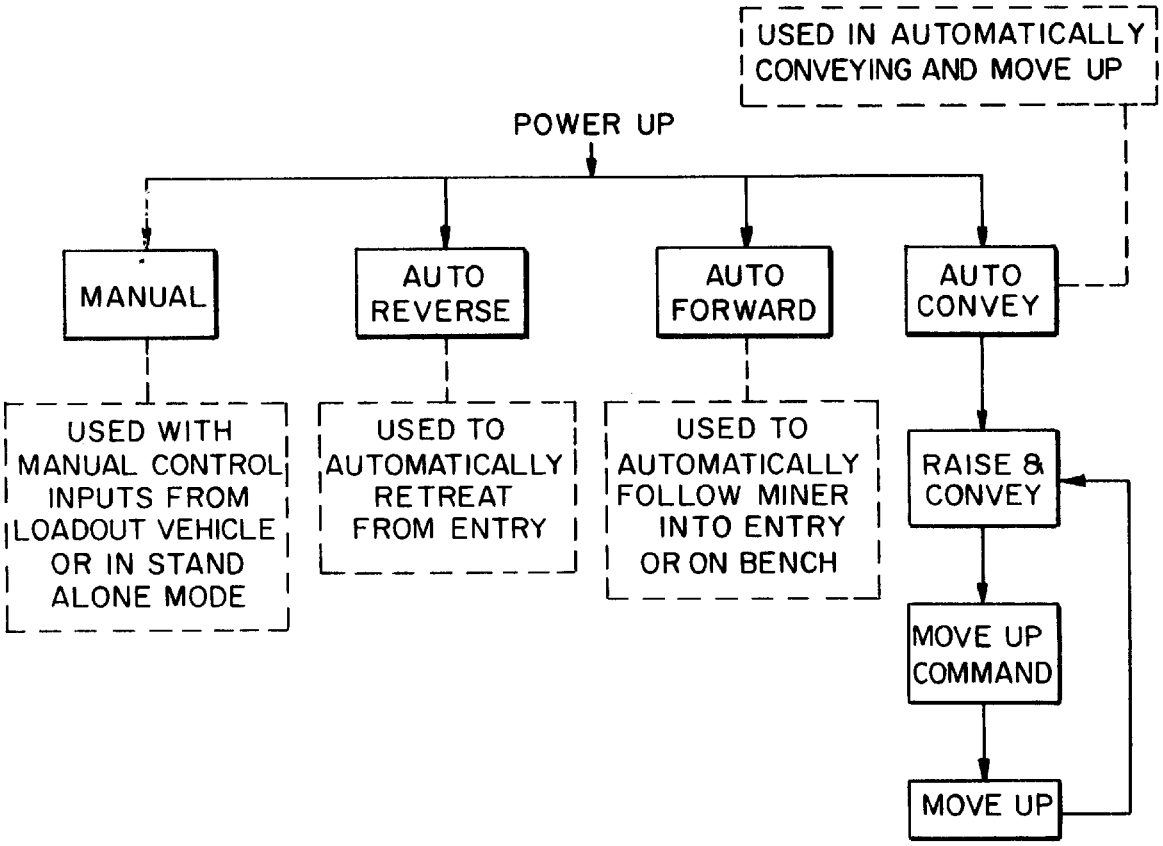
FIG. 18 is a flow diagram for the overall operation of the tramming conveyor processor.

The various modes of operation of miner processor 162 and conveyor processor 164 are shown in the flowcharts of FIGS. 17 and 18, respectively. In the automatic mining or "auto mine" mode of operation, control signals supplied from inclinometers 163 and ring laser gyroscopes 165, as well as control parameters previously supplied from the operator on the load-out vehicle, will enable miner processor 162 to properly and automatically mine a coal seam and stay within the seam. Although the roof and floor gamma ray sensors 91 and 90 could be used to automatically mine the coal and ensure that the continuous miner stays within the seam, it is presently preferred to use the roof and floor gamma sensors 91 and 90 merely to provide information to the operator for making proper initial settings and interim modifications for overall operation. In this manner, the continuous miner cuts a smooth floor that is advantageous for subsequent operation of the tramming conveyor, rather than allowing the continuous miner to follow irregularities which occur in the boundary between the coal seam and strata in the roof and floor. As shown in FIG. 17 of the drawings, in the auto mine mode of operation, the continuous miner sumps in at the top of the seam, shears down, sumps in at the bottom of the seam, checks the distance to the inby end of the tramming conveyor, and then either shears up, or both shears up and moves the tramming conveyor forwardly, before returning to the initial step of sumping in at the top of the seam. However, it should be understood that the miner can be operated according to other sequences if desired.

Referring to FIG. 18 of the drawings in the "auto convey" mode of operation for conveyor processor 164, which is used when the continuous miner is in the "auto mine" mode of operation, conveyor processor 164 will, as primarily controlled by miner processor 162, send signals to extend the hydraulic cylinders in jacks 16 to raise the tramming conveyor above the mine floor to convey mined coal to the load-out vehicle. When conveyor processor 164 receives a particular command from miner processor 162, as dictated by the spacing between the rear end of continuous miner 1 and the inby end of tramming conveyor 20, which is detected by rotary encoder 74 on the continuous miner, the conveyor on the continuous miner will stop conveying coal to the tramming conveyor for a defined period of time. The tramming conveyor will continue to convey coal rearwardly toward load-out vehicle 30 for a predetermined period of time sufficient to provide a clear area on the top of the chain in the tramming conveyor in the hopper section and hydraulic jacks 16 will be retracted to lower the tramming conveyor to the mine floor. The conveyor processor will provide a move-up command which reverses the direction of operation of the chain in the tramming conveyor to tram the entire conveyor forwardly toward the rear end of the continuous miner until a preset minimum spacing is achieved. The steps of continuously mining, moving the continuous miner forward, conveying the mined coal to the load-out vehicle, interrupting the conveying of coal from the continuous miner to the tramming conveyor, tramming the tramming conveyor forwardly toward the rear end of the continuous miner and thereafter resuming conveyance of mined coal from the continuous miner to the load-out vehicle are serially repeated as the entire mining system progresses into the hole.

Conveyor processor 164 can also operate tramming conveyor 20 in an "auto forward" mode of operation as shown in FIG. 18 of the drawings. This mode of operation is used when the continuous miner is being advanced along the bench or into an entry under manual control. In this mode of operation, the tramming conveyor merely follows along behind the continuous miner at a preselected distance therefrom. The miner processor is operated in a manual control mode of operation (see FIG. 17) by manual control input signals from load-out vehicle 30. In addition, the tramming conveyor can be controlled in a manual control mode of operation, in a stand-alone mode or with manual control inputs from the load-out vehicle. In the stand-alone mode of operation, the tramming conveyor is controlled by outby hand-held controller 140 supplying control signals to conveyor computer 132, or by inby hand-held controller 138 which directly controls the inputs and outputs 136 on the tramming conveyor.

Two additional and important modes of operation are provided for the continuous miner and the tramming conveyor in accordance with the invention. As described above, parallel data highways 118 and 120 are provided between miner computer 126 and conveyor computer 132. Normal data communications are provided over primary data highway 118, although the system continuously monitors to determine that both data highways 118 and 120 are operating properly. If one of data highways 118 or 120 is lost, for any reason, miner processor 162 and conveyor processor 164 are automatically switched to an automatic reverse mode of operation. In this mode of operation, all mining and conveying are stopped, and all systems are operated over the remaining, functional data highway to permit the continuous miner and the tramming conveyor to be reversed out of the hole. This reverse mode of operation, with all mining stopped, will occur if one of the data highways fails which indicates a problem under which normal mining operations relying on only the remaining data highway is not advisable. In this manner, it is possible to safely back the complete mining system out of the hole under either normal computer control or manual control so that inspection and repair can be made.

In the event that both data highways 118 and 120 fail, conveyor computer 132 is switched to a mode of operation completely controlled by miner computer 126 and miner computer 126 is switched to a radio remote controlled mode of operation. Under this control mode, both the continuous miner and the tramming conveyor stop all normal operations and wait to receive control signals supplied from radio receiver 124 to miner computer 126. As described above, a hand-held controller 156 transmits radio control signals over coaxial cable 122 and these signals are propagated in the air along the hole, particularly at the continuous miner, and received by radio receiver 86 on continuous miner 1. Miner computer 126 will then control the operation of continuous miner 1 and tramming conveyor 20 as dictated by the control signals transmitted by hand-held controller 156 manually operated near the load-out vehicle.

Load-out vehicle processor 166 operates only in a manual mode of operation with panel and control cab inputs. The load-out vehicle processor 166 monitors all essential onboard functions and reports status data to the other processors and to graphic interface computer 150. Graphic interface computer 150 provides graphic man/machine interfacing for machine control. It displays status and operating screens and permits the operator to override programmed, calculated mining parameters to cover unusual situations. Operating panels 146 provide a means for the operator to supply desired mining parameters to miner processor 162 and to display the status of various operating functions. Miner processor 162 also monitors all essential onboard functions and reports status and position data to the other processors and to graphic interface computer 150. It also calculates all mining parameters and acts as the "master" controller when communicating to the other processors during the automatic mining mode of operation. Conveyor processor 164 also monitors all essential onboard functions and reports status data to the other processors and to graphic interface computer 150. Conveyor processor 164 functions as a "slave" controller to miner processor 162 except when it is operating in the manual or stand-alone modes of operation.

The mining process is started by a mechanic/electrician locating the continuous miner on the bench at the desired entry into the highwall hole. Remote control by radio receiver 86 is used to position the continuous miner in the correct heading and at the appropriate lateral spacing from the preceding or adjacent highwall hole. After the continuous miner is in position, the operating technician in the load-out vehicle is advised by radio or the like that the system is ready to be controlled by the computer operation. The operating technician initiates the computer controls to fully automate the mining cycle. The computers are programmed to cut, load, and convey the mined coal automatically. The continuous miner automatically sumps in at the top of the seam, shears down, sumps in at the bottom of the seam and shears up in a continuous cycle. The miner is programmed to continue that cycle until it advances a preset distance from the inby end of the tramming conveyor. When that preset distance is reached, the end discharge of the boom for discharge conveyor 9 on continuous miner 1 is located at the inby end of tramming conveyor 20 above hopper section 24. The tramming conveyor is automatically moved up close to the rear end of the continuous miner. The mining cycle is then repeated until it is time to advance the tramming conveyor. The location of the boom on the continuous miner relative to the inby end of the tramming conveyor is monitored by the computer system so that mined coal is transferred with a minimum of spillage. During the tramming conveyor advance sequence, the continuous miner is programmed to cut in the shear up cycle which permits the area below the rotary drum in front of the pan to function as a bunker or a storage space for mined coal. This allows the cutting head on the continuous miner to continue to cut coal while tramming conveyor 20 is advancing toward the rear end of the continuous miner and not conveying coal rearwardly out of the hole. When the computers signal the tramming conveyor to advance, miner discharge conveyor 9 is automatically stopped while tramming conveyor 20 continues to run just long enough to clear the top of the conveyor chain at the inby end in hopper section 24 to prevent spillage behind the continuous miner. The computers then signal the tramming conveyor to retract hydraulic jacks 16 and lower the conveyor so that the chain 21 contacts the ground in the tramming mode, advances toward the continuous miner, and extends hydraulic jacks 16 to raise the conveyor into the conveying mode to enable the mined coal to be conveyed toward load-out vehicle 30. As soon as the entire return side of the conveyor chain 21 is off the ground, tramming conveyor 20 and continuous miner discharge conveyor 9 are started and the mining cycle is repeated.

Mining navigation and coal quality are constantly monitored by gamma detectors 90 and 91, inclinometers 163 and gyroscope 165 on continuous miner 1. Data from these instruments are supplied to miner processor 162, as discussed above, where the data are analyzed. Miner processor 162 automatically signals continuous miner 1 if any adjustments are needed to keep the continuous miner in the seam and on azimuth.

Self-diagnostics are incorporated into the controls for system protection and to improve troubleshooting speed. The coolant system temperatures on the continuous miner are monitored at the inlet and the outlet. The electrical control boxes in the continuous miner and the tramming conveyor are also monitored to assure safety and early detection of potential problems. Motor currents are monitored for all conveyor drive motors and warning lights signal the operator of impending overload conditions. Similarly, motors on the continuous miner are monitored, including the miner pump motor, gathering head motors, cutter head motors and tram motors, in order to alert the operator of potential problems. System electric current is monitored at the load-out vehicle power center and cooling fans are automatically started as required. Critical mining sequence functions, such as miner heading and pitch, are displayed for the operating technician's constant review. The status of the equipment within the mining cycle is continuously displayed as the system cycles through the continuous miner's top sump, shear down, bottom sump and shear up steps.

A data acquisition system is provided in load-out vehicle processor 166. The data acquisition system provides a history of key operating parameters for the entire mining system. Since every step taken by the mining system is controlled by a computer, every step can be timed and recorded. This data acquisition system is in essence a real time, time study automatically generated for the entire system. It records the number of shear downs and shear ups, for example, and the average time and maximum time it takes for these cycles. Those times, in addition to the recordation of the sump distances for both top and bottom sumps, can provide an instantaneous review of the machine performance and a comparison with established cutting records.

While one embodiment of the invention is described in detail herein, it will be appreciated by those skilled in the art that various modifications and alternatives to the embodiment can be developed in light of the overall teachings of the disclosure. Accordingly, the particular arrangements are illustrative only and are not limiting as to the scope of the invention which is to be given the full breadth of the appended claims and any and all equivalents thereof.

We claim:

1. A method of controlling the operation of a continuous mining system including a continuous miner having a forward end with a cutting means and a rear end, an articulated tramming conveyor having an inby end operatively connected to and trailing said rear end of said continuous miner and an outby end spaced from said inby end, and a load-out vehicle at said outby end operatively connected to and trailing said tramming conveyor, said method comprising the steps of:

a) providing a master computer processor on said continuous miner, b) providing at least one slave computer processor for controlling elements of said mining system other than said continuous miner, under the direction of said master computer processor, c) providing a pair of parallel data communication highways between said master computer processor and said slave computer processor, d) providing a radio communication path between said master computer processor and said outby end, e) monitoring the functional status of said data communication highways, f) operating said mining system through said master computer processor in an automatic mining mode of operation when both of said data communication highways are functional, g) operating said mining system through said master computer processor in a reverse mode of operation if either of said data communication highways fails to function, whereby all mining operations cease and said mining system may be reversed out of a mine hole, and h) operating said mining system through said master computer processor in a manual, radio controlled mode of operation over said radio communication path if both data communication highways cease to function, whereby the master computer processor stops all automatic operations and is controlled solely by control signals over said radio communication path.

2. The method of claim 1 wherein said slave computer processor is located at said outby end of said tramming conveyor.

3. The method of claim 2 wherein said parallel data communicator highways are a pair of data cables extending from said load-out vehicle along the length of said tramming conveyor from said slave computer processor to said master computer processor.

4. The method of claim 1 wherein said radio communication path is a radio wave transmitting cable extending from said load-out vehicle along the length of said tramming conveyor to said continuous miner and a radio receiver on said continuous miner which is operatively connected to and supplies control signals to said master computer processor.

5. The method of claim 4 wherein said radio wave transmitting cable is a coaxial cable.

6. The method of claim 1 including:

i) controlling the sequential cutting operation of said cutting means on said continuous miner in a coal seam, said method including sumping said cutting means inwardly at the top of the coal seam, shearing said cutting means downwardly to the bottom of the coal seam, sumping said cutting means inwardly at the bottom of the coal seam, and shearing said cutting means upwardly to the top of the coal seam in continuous repetitive cutting cycles until said rear end of said continuous miner is spaced a predetermined maximum distance from said inby end of said tramming conveyor, j) constantly measuring said distance between said rear end of said continuous miner and said inby end of said tramming conveyor, k) interrupting the operation of said cutting means on said front end of said continuous miner, l) lowering said tramming conveyor to the ground to tram said tramming conveyor toward said rear end of said continuous miner when said rear end of said continuous miner reaches said predetermined maximum distance from said inby end of said tramming conveyor until a second preselected minimum distance is measured, m) raising said tramming conveyor from the ground to convey coal, and n) initiating the sequential cutting operation of step i).

7. Apparatus for controlling the operation of a continuous mining system having an outby end including a continuous miner having cutting means, an articulated tramming conveyor having an inby end operatively connected to and trailing said continuous miner, and a load-out vehicle operatively connected to and trailing said tramming conveyor, said apparatus comprising:

a) a master computer processor on said continuous miner, b) at least one slave computer processor at said outby end of said mining system for controlling elements of said mining system other than said continuous miner under the direction of said master computer processor, c) a pair of parallel data communication highways between said master computer processor and said slave computer processor, d) a radio communication path between said master computer processor and said outby end of said mining system, e) monitoring means for monitoring the functional status of said data communication highways, f) means in said master computer processor for operating said mining system in an automatic mining mode of operation when both of said data communication highways are functional in response to said monitoring means, g) means in said master computer processor for operating said mining system in a reverse mode of operation if either of said data communication highways fails to function in response to said monitoring means, whereby all mining operations cease and said mining system may be reversed out of a mine hole, and h) means in said master computer processor for operating said mining system in a manual, radio controlled mode of operation using said radio communication path if both data communication highways cease to function in response to said monitoring means, whereby said master computer processor stops all automatic operations and is controlled solely by control signals over said radio communication path.

8. Apparatus as set forth in claim 7 wherein said slave computer processor is located at an outby end of said tramming conveyor.

9. Apparatus as set forth in claim 8 wherein said parallel data communicator highways are a pair of data cables extending from said load-out vehicle along the length of said tramming conveyor from said slave computer processor to said master computer processor.

10. Apparatus as set forth in claim 7 wherein said radio communication path is a radio wave transmitting cable from said load-out vehicle extending along the length of said tramming conveyor to said continuous miner and a radio receiver on said continuous miner which is connected to and supplies control signals to said master computer processor.

11. Apparatus as set forth in claim 10 wherein said radio wave transmitting cable is a coaxial cable.

12. Apparatus as set forth in claim 7 wherein said tramming conveyor includes a continuous conveyor chain, a plurality of electric drive motors distributed along its length and driving said conveyor chain, power distribution means extending from said load-out vehicle along the length of said tramming conveyor for supplying electrical power to said drive motors, said power distribution means including a plurality of parallel power buses, each of said power buses supplying power to non-sequential drive motors spaced along the length of said tramming conveyor and each of said drive motors in said tramming conveyor connected to one of said plurality of power buses.

13. Apparatus as set forth in claim 12 wherein said drive motors connected to a particular power bus are evenly spaced from each other along the length of said tramming conveyor.

14. Apparatus as set forth in claim 7 including a cutting control means for controlling a sequential cutting operation of said cutting means on said continuous miner, said cutting control means operating said cutting means to sump inwardly at the top of a coal seam, shear downwardly to the bottom of the coal seam, sump inwardly at the bottom of the coal seam and shear upwardly to the top of the coal seam in continuous repetitive cutting cycles.

* * * * *